US010640938B2

(12) United States Patent
Renger et al.

(10) Patent No.: US 10,640,938 B2
(45) Date of Patent: May 5, 2020

(54) SUCTION EXCAVATOR WITH FLOW REVERSAL AND METHOD FOR CONTROLLING SAME

(71) Applicant: RESCHWITZER SAUGBAGGER PRODUKTIONS GMBH, Saalfeld (DE)

(72) Inventors: Marina Renger, Saalfelder Hoehe (DE); Karl-Heinz Renger, Saalfelder Hoehe (DE); Jens Graber, Saalfelder Hoehe (DE)

(73) Assignee: RESCHWITZER SAUGBAGGER PRODUKTIONS GMBH, Saalfeld (DE)

( * ) Notice: Subject to any disclaimer, the term of this patent is extended or adjusted under 35 U.S.C. 154(b) by 300 days.

(21) Appl. No.: 15/565,990

(22) PCT Filed: Apr. 8, 2016

(86) PCT No.: PCT/EP2016/057710
§ 371 (c)(1),
(2) Date: Oct. 12, 2017

(87) PCT Pub. No.: WO2016/166021
PCT Pub. Date: Oct. 20, 2016

(65) Prior Publication Data

US 2018/0119375 A1 May 3, 2018

(30) Foreign Application Priority Data

Apr. 16, 2015 (DE) ..... 10 2015 105 836

(51) Int. Cl.
*E01H 1/08* (2006.01)
*E02F 3/94* (2006.01)
(Continued)

(52) U.S. Cl.
CPC ..... *E01H 1/0836* (2013.01); *B08B 5/04* (2013.01); *E01H 1/0809* (2013.01);
(Continued)

(58) Field of Classification Search
CPC . E21B 7/18; E21B 7/06; E21B 21/063; E21B 43/29; E02F 3/92; E02F 3/8825;
(Continued)

(56) References Cited

U.S. PATENT DOCUMENTS 3,842,461 A * 10/1974 Wurster ..... B08B 5/04 15/326
3,930,324 A * 1/1976 Wightman ..... E02F 3/8825 37/189
(Continued)

FOREIGN PATENT DOCUMENTS

DE 33 18 756 C2 11/1984
DE 38 24 710 C2 1/1990
(Continued)

OTHER PUBLICATIONS

English translation of the International Preliminary Report on Patentability dated Oct. 17, 2017 issued in connection with corresponding International Application No. PCT/EP2016/057710 (7 pages total).

*Primary Examiner* — Robert E Pezzuto
(74) *Attorney, Agent, or Firm* — Mayer & Williams, PC; Stuart H. Mayer

(57) ABSTRACT

A suction excavator includes a suction hose with a suction opening for pneumatically receiving solid or liquid suction material using a fast-flowing air stream. The suction excavator has a separator for separating the suction material from the air stream, a filter unit for cleaning the air stream, a fan unit for generating the air stream, and a recirculation channel that is connected to the pressure side of the fan unit via a
(Continued)

volume-controllable recirculation opening. A volume-controllable secondary air opening allows secondary air from the surroundings to be supplied to the suction side of the fan unit, downstream from the filter unit in the flow direction. The recirculation channel is fluidically coupleable to the suction hose to generate a positive pressure in the recirculation channel to blow out recirculation air through the suction hose.

11 Claims, 3 Drawing Sheets

(51) Int. Cl.
*E02F 3/88* (2006.01)
*E02F 3/90* (2006.01)
*B08B 5/04* (2006.01)

(52) U.S. Cl.
CPC ..... *E02F 3/8816* (2013.01); *E02F 3/905* (2013.01); *E02F 3/907* (2013.01); *E02F 3/94* (2013.01)

(58) Field of Classification Search
CPC ..... E02F 3/8816; E02F 3/88; E02F 3/8891; E02F 5/003; E02F 3/94; E02F 3/905; E02F 3/907; E01H 1/08; E01H 1/0836; E01H 1/0809; B65G 53/24; B08B 5/04
USPC ..... 37/305, 309, 315–321, 323; 175/66, 67, 175/206, 213, 424; 299/17
See application file for complete search history.

(56) References Cited

U.S. PATENT DOCUMENTS

| | | | | |
|---|---|---|---|---|
| 4,570,287 | A | 2/1986 | Kerschner et al. | |
| 5,016,717 | A * | 5/1991 | Simons | E02F 5/003 175/206 |
| 5,425,188 | A * | 6/1995 | Rinker | B01D 45/06 175/206 |
| 6,112,439 | A * | 9/2000 | Rinker | E02F 3/92 37/305 |

FOREIGN PATENT DOCUMENTS

| | | | |
|---|---|---|---|
| DE | 10 2010 060 973 | A1 | 6/2012 |
| EP | 1 211 354 | A2 | 6/2002 |
| FR | 2 286 772 | | 4/1976 |
| WO | 2015/024558 | A1 | 2/2015 |

* cited by examiner

SUCTION EXCAVATOR WITH FLOW REVERSAL AND METHOD FOR CONTROLLING SAME

FIELD

The invention relates to a suction excavator for pneumatically receiving solid or liquid suction material by means of a fast-flowing suction air stream in a suction line. The invention further relates to a method for controlling such a suction excavator.

BACKGROUND

DE 38 24 710 C2 discloses a device that is suitable for suctioning granular material from the floor in order to clean the material. A blowing air stream branches off from the pressure side of the blower that generates the suction air stream, and is directed onto the granular material, lying on the floor, via a separate channel.

A device is known from DE 33 18 756 C2 for receiving wastes by means of a suction air stream that is impelled by a blower. A portion of the air stream, generated by the blower, that is recirculated in a separate channel is used for removing wastes from the floor.

EP 1 211 354 A2 describes a method for cleaning lightweight, fine-particle contaminants from stone materials. For this purpose, a suction excavator is used which has a suction tube that is connected to a suction pump via a tank. The air volumetric flow rate in the suction tube is set so that the stone materials are kept suspended, while the more lightweight contaminants are suctioned off. The cleaned stones are then set down again by temporarily reducing the suctioning air volumetric flow rate.

In all suction excavators that are available on the market, radial fans generate large, very fast-flowing air streams that entrain a material to be received (also referred to below as suction material), which is situated in the area of the suction opening of a suction hose. However, at temperatures around the freezing point, the fast-flowing suction air stream results in rapid cooling of the components of the suction excavator upstream from the fan in terms of flow. For this reason, the air-conducting components of the suction excavator may freeze at low temperatures. In addition, moist suction material in the suction hose or in the separator, for example, may freeze on. Likewise, the ultrafine filters used in the downstream filter unit may freeze, resulting in a sharp reduction in the suction air flow and thus, in the conveying capacity.

A system is known from FR 2 286 772 that leads the air, which is compressed in a vacuum pump, back to a suction point via a separate channel. In the process, the heat of the recirculated air may also be utilized to thaw frozen material.

DE 10 2010 060 973 A1 discloses a control method for a suction blower of a suction excavator, in which the suction blower is driven by an internal combustion engine via a drive train. The suction blower is a system made up of a first radial fan and at least one additional radial fan. A bypass line is situated between the suction line of the first fan and the exhaust air line of the additional fan. An internally or externally controlled bypass flap, which in the open state allows partial recirculation of the conveyed air stream and which is closed during normal operation, is situated in the bypass line.

Lastly, a suction excavator is known from WO 2015/024558 A1, which in a known manner includes a suction hose with a suction opening for pneumatically receiving suction material by means of a fast-flowing suction air stream. In addition, a separator for separating the suction material from the air stream, as well as a filter unit for cleaning the air stream are provided. A fan generates the suction air stream. The suction side of the fan is connected to the outlet of the filter unit, and the pressure side is connected to an exhaust air channel. The exhaust air channel opens to the surroundings via an exhaust air opening. In addition, a portion of the exhaust air stream may be led via a recirculation channel to internal components of the suction excavator, for example back into the separator, in order to heat the deposited suction material at that location. Likewise, a section of the recirculation channel extends, separately from the suction hose, to the vicinity of the suction opening in order to convey heated exhaust air to that location. For this previously known suction excavator, however, it is still disadvantageous that a separate channel must be led to the suction opening in order to heat the suction material to be received. Since the pressure in the recirculation channel that is generatable by the fan is not high, this channel must be led with a relatively large cross section up to the suction opening, which not only increases the costs of the suction excavator, but also in particular makes handling the suction hose more difficult. In addition, there is a risk that the drawn-in suction material may once again freeze in the suction hose when the ambient temperatures are low.

Proceeding from WO 2015/024558 A1, it is considered to be an object of the present invention to provide a further improved suction excavator in which freezing in the suction hose is avoided or may be reversed without the need for costly heating elements. A further aim is that attaching a separate recirculation channel that extends to the suction opening may be avoided altogether, or that in any case a smaller cross section is required for the recirculation channel. A further object is to provide a method for the improved control of such a suction excavator.

SUMMARY

This object is achieved, firstly, by a suction excavator according to appended claim 1.

The suction excavator according to the invention first of all has at least the following components: a suction hose with a suction opening is used for pneumatically receiving solid or liquid suction material, in that a fast-flowing suction air stream is drawn through the suction hose and entrains the suction material in the vicinity of the suction opening. The air stream together with the received suction material is supplied to a separator, where the flow velocity is drastically reduced due to the cross-sectional expansion in the flow path, in order to deposit and collect the coarse, heavy components of the suction material from the air stream. The air stream is then supplied to a filter unit, situated downstream from the separator in the flow direction, for cleaning the air stream. The filter unit is preferably made up of multiple filter levels, and is adapted to the components that are customarily contained in the suction material. A fan unit is used to generate the air stream. Two or more radial fans are preferably used, which are particularly preferably fluidically connected one behind the other, in order to achieve a high negative pressure and thus a high flow velocity in the suction air stream. The suction side of the fan unit communicates with the outlet of the filter unit, and the pressure side is connected to an exhaust air channel. The exhaust air channel opens into an exhaust air opening to the surroundings, so that in any case the exhaust air is emitted to the outside during the normal operating state (suction mode). A recirculation channel is connected to the pressure side of the fan unit, preferably in the area of the exhaust air channel, via a volume-controllable recirculation opening. The recirculation channel preferably opens into the separator in order to recirculate portions of the exhaust air stream back to the separator. In modified embodiments, heated exhaust air as recirculation air may also be led to further components of the suction excavator via the recirculation channel.

The invention is characterized in particular in that a volume-controllable secondary air opening is provided on the suction excavator, which, downstream from the filter unit in the flow direction, allows secondary air from the surroundings to be supplied to the suction side of the fan unit. Additional ambient air may thus also then be drawn in by the fan unit via the secondary air opening in the event that the suction hose is completely closed due to icing, for example. At the same time, in the suction excavator according to the invention, the ratio of exhaust air (recirculation air), led back via the recirculation channel and via the exhaust air opening, to the exhaust air that is emitted to the surroundings may be controlled, preferably by flow guiding elements, throttle elements, or the like. A positive pressure may thus be generated, initially in the recirculation channel and, if the latter is fluidically connected to the separator, also in the separator, by the fan compressing the secondary air, drawn in via the secondary air opening, and recirculating it. This pressure increase may ultimately be utilized for reversing the flow direction in the suction channel, so that exhaust air is blown through the suction hose up to the suction opening. In the simplest case, the positive pressure is generated in the separator, which fluidically communicates directly with the suction hose. In one modified embodiment, the recirculation channel may also be connected to the suction hose via appropriate flow-conducting means such as diverter flaps.

It should be noted that the quantity of air that is optionally circulated multiple times by the fan is heated by energy input, so that the recirculation air that is present with positive pressure in the recirculation channel or in the separator has a much higher temperature than the ambient air (for example, approximately 20 to 40 K higher than the ambient air), and may therefore be utilized for heating the suction hose at low ambient temperatures.

The secondary air opening is preferably equipped with a controllable secondary air control system which is preferably designed as a secondary air flap, and by means of which a targeted, controllable admixture of cold outside air into the air stream takes place. Due to the controlled suction intake of cold outside air, it is possible to regulate and hold constant the temperature of the air stream in the suction excavator. This is advantageous in particular when a fluidic short circuit is created which produces high temperatures.

According to one preferred embodiment, the suction excavator has further air ducts and flow-conducting means in order to utilize the heat energy, introduced by the compression of the air when it passes through the fan unit, for heating the components upstream from the fans.

The fan unit is preferably a radial fan, an axial fan, or a compressor having some other design. Multiple fans which are identical or different may particularly preferably be connected in series or in parallel.

In one preferred design of the suction excavator, the recirculation channel extends to the separator, to which the suction hose is attached, in order to push the recirculation air along this path into the suction hose.

The recirculation channel preferably begins upstream from the blocking and/or diverting system for the exhaust air, and is designed in such a way that the heated air may be selectively recirculated to the components situated upstream from the fans. For this purpose, flow-regulating means are provided in the recirculation channel which may release or block the heated air stream and supply it to individual components in a targeted manner. The recirculation channel preferably has multiple outlets. Flow-conducting and/or flow-blocking means (referred to collectively as flow-regulating means) for ventilating one or more components are associated with the outlets, so that one or more components may be ventilated in a controlled manner. The recirculation channel may have various cross sections and dimensions, which may also be varied along the course of the recirculation channel. In other designs, the recirculation channel may also have a divided design, or may be made up, entirely or in areas, of multiple individual channels.

One particular embodiment of the suction excavator allows operation in a short circuit mode. At least the exhaust air opening is hereby divided; i.e., the emission of exhaust air is interrupted, so that the stream generated by the fan flows only within the suction excavator across the particular components that are connected. In the simplest case, the air is conveyed only through the filter unit and the fan, resulting in rapid heating of the air, for example to thaw frozen filter sections. The separator may be incorporated into the short circuit flow as needed, if heat is required at that location. Blocking the suction hose (even if possible) is not necessary for this purpose, since no suction intake takes place when the air is not emitted via the exhaust air opening.

The quantity of recirculated air is regulatable via the controlled blocking and/or diverting system for the exhaust air of the fan. Depending on the activation state of the blocking and/or diverting system for the exhaust air, in other words, as a function of the selected position of the flow-regulating means, it is possible to bring about a fluidic short circuit, and thus also a thermal short circuit, so that the short circuit mode is adopted.

To avoid damage to the suction excavator due to excessive temperatures of the air stream, the blocking and/or diverting system for the exhaust air of the fan is advantageously controllable by evaluation of measured values of temperature sensors.

The outlets of the recirculation channel may be designed, for example, as holes or slots in an outer wall of the recirculation channel. A flow-regulating means is associated with each of these outlets. The actuation of the flow-regulating means may be implemented mechanically, electrically, hydraulically, or pneumatically, and may be monitored and triggered by a controller. Actuation may also be possible manually, in addition to computer-assisted or control loop-based actuation.

In one special embodiment, a parallel air duct which is led in parallel to the suction hose and which ends at a small distance from the suction opening may be connected to the recirculation channel. The distance and the orientation of the outlet of the parallel air duct are selected in such a way that a portion of the recirculation air which is led in the recirculation channel and which exits from the outlet is drawn back in, at least in part, via the suction opening and resupplied to the suction excavator. As the result of such a design, a portion of the warm recirculation air is guidable in front of the suction opening, and to a large extent is drawn back into the suction hose during operation of the suction excavator. The distance of the outlet from the suction opening may be settable to allow different ambient temperatures and operating conditions of the suction excavator to be addressed.

Moreover, the invention provides a method for controlling a suction excavator according to appended claim 8.

The method according to the invention is characterized in that, firstly, the suction excavator may be placed in at least two different operating modes.

In a suction mode, a fan unit for generating an air stream is activated, and flow-regulating means are set in such a way that the air stream extends over a suction flow path. The suction flow path begins at a suction opening of a suction hose in order to receive suction material at that location, extends to a separator where the majority of the suction material is separated, then further through a filter unit, to the fan unit, and from there to an exhaust air opening in order to emit the cleaned exhaust air to the surroundings. In suction mode, the exhaust air opening is open, while all return line flaps (which are a component of the flow-regulating means) and the secondary air flap are preferably completely closed.

In a blow-back mode, the fan unit for generating an air stream is once again activated, and flow-regulating means are set in such a way that the air stream extends, at least partially, over a blow-back path. The blow-back path begins at a secondary air opening at which secondary air is drawn in from the surroundings. For this purpose, the secondary air opening is situated at a position in the flow direction upstream from the suction side of the fan and downstream from the filter unit. The secondary air path extends further through the fan unit, into a recirculation channel, and up to the suction hose and its suction opening. A positive pressure is generated in the recirculation channel due to drawing in secondary air, without the need for changing the rotational direction of the fans. The recirculated air that is heated by the fan unit is pushed into the suction hose, and in this way transports heat, as needed, up to the suction opening without having to lead a separate hose in parallel to the suction hose.

According to one preferred embodiment, the method allows an additional operating mode, a short circuit mode. In the short circuit mode, the fan unit for generating an air stream is likewise activated, and the flow-regulating means are set in such a way that the air stream extends, at least partially or also completely, over a closed short circuit flow path. The short circuit flow path extends at least through the filter unit to the fan unit, and from there, back to the filter unit. However, the short circuit flow path may also include the space of the separator and/or further channels or components. It is important that no air is supplied from the outside or emitted to the outside. The energy introduced by the fan may thus be utilized for rapidly heating the circulated air, in particular when individual components of the suction excavator must be heated quickly.

The short circuit mode is necessary in particular when freezing of components is possible or has occurred. In this operating mode, the exhaust air opening is closed and one or more return line flaps are open in order to free the recirculation channel. In any case, the secondary air flap is likewise initially closed. The air volume present in the vehicle is repeatedly conveyed by the fans, and with each pass receives input heat energy in the form of compression. As a result, the temperature of the air rises quickly. This operation may also be referred to as the heat-up phase. In one advantageous embodiment, the achieved temperature is continuously monitored by sensors.

The above-mentioned blow-back mode is preferably activated starting from the short circuit mode. When a predefined maximum temperature is reached, for this purpose the secondary air opening, which is preferably installed close to the suction side of the fans, may be opened. In this state the flow resistance across the secondary air opening is less than the circulation resistance of the internal air volume of the suction excavator. Thus, in addition to the circulation of the internal air volume, an additional quantity of ambient air is drawn in. This ambient air mixes with the circulating, hot short circuit air flow. Since the exhaust air opening is closed and the internal air volume does not change, the recirculation air stream is transported into the suction line.

According to one preferred embodiment, in addition a suction mode having a heat-up function may be selected. This suction mode allows suction operation at reduced power, and at the same time, heat-up of the internal components. Due to the powerful fan unit, in the normal suction mode (see above) air velocities in the suction hose or at the suction opening are achieved which in many applications are greatly above the value that is necessary for transporting the suction material. In the suction mode with a heat-up function, at constant fan power the air volume, and thus also the air velocity, in the suction hose are reduced to a level that is still sufficient for transporting the suction material. The volume difference that results from subtracting the minimal air flow volume in the suction hose from the fan volume output is supplemented by circulating air within the suction excavator. The circulated air volume flows along the above-described short circuit path, resulting in increased heating of the overall volumetric flow.

In suction mode with a heat-up function, initially the exhaust air opening and the secondary air opening are closed, and the blocking means in the recirculation channel (component of the flow-regulating means) are partially or completely open. If the fan is now started, this initially corresponds to the short circuit mode. If the exhaust air opening is now partially opened, a portion of the suction air stream that has been heated by passing through the fans may pass to the surroundings, depending on the degree of opening. Since the internal air volume and the conveying capacity of the fans do not change, the same quantity of this air stream is subsequently drawn in via the suction hose. The quantity of the suction air stream that results at the suction opening is thus regulated via the volumetric flow at the exhaust air opening. With an appropriate setting, this reduced-power suction air stream is capable of entraining material that is present in the area of the suction opening. The cold outside air that is drawn in and the air that is continually heated in circulation mode are intermixed inside the suction excavator. Freezing of the internal components of the suction excavator during suction operation is thus prevented. It should be noted that the suction mode with a heat-up function manages without secondary air that is drawn in via the secondary air opening, so that this operating mode may also be used in suction excavators that have no secondary air opening.

BRIEF DESCRIPTION OF THE DRAWINGS

Further advantages and particulars of the invention result from the following description of one preferred embodiment, with reference to the drawings, which show the following.

DETAILED DESCRIPTION

Figure 1:
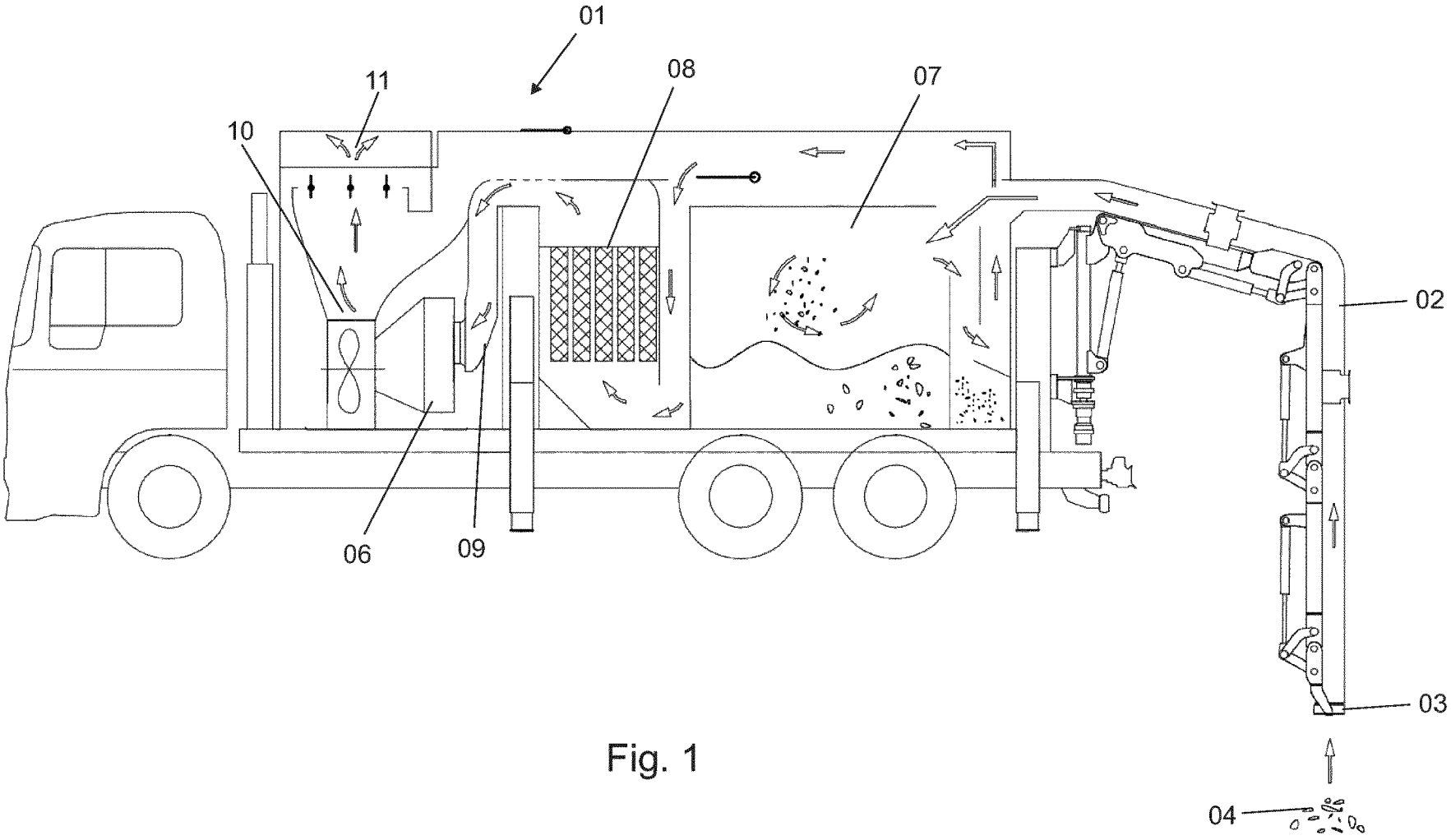
FIG. 1 shows a schematic illustration of one embodiment of a suction excavator according to the invention, in suction mode.

The schematic illustration shown in FIG. 1 depicts in a simplified fashion a suction excavator 01 according to the invention, which is operated in a suction mode. The illustrated flow arrows indicate the resulting air stream over a suction flow path. The suction excavator 01 includes a suction hose 02 with a suction opening 03 into which the suction material 04 which is to be received is drawn in in the suction mode. For this purpose, a fan unit 06 generates a suction air stream which, beginning at the suction opening 03, flows through a separator 07, then through a filter unit 08, to the fan unit 06. Coarse, heavy components of the suction material are deposited in the separator 07, while all fine, lightweight components are filtered out by the filter unit 08. The cleaned air is drawn into the fan unit 06 at a suction side 09, discharged at a pressure side 10, and emitted to an exhaust air opening 11, where it passes from the suction excavator into the surroundings.

Figure 2:
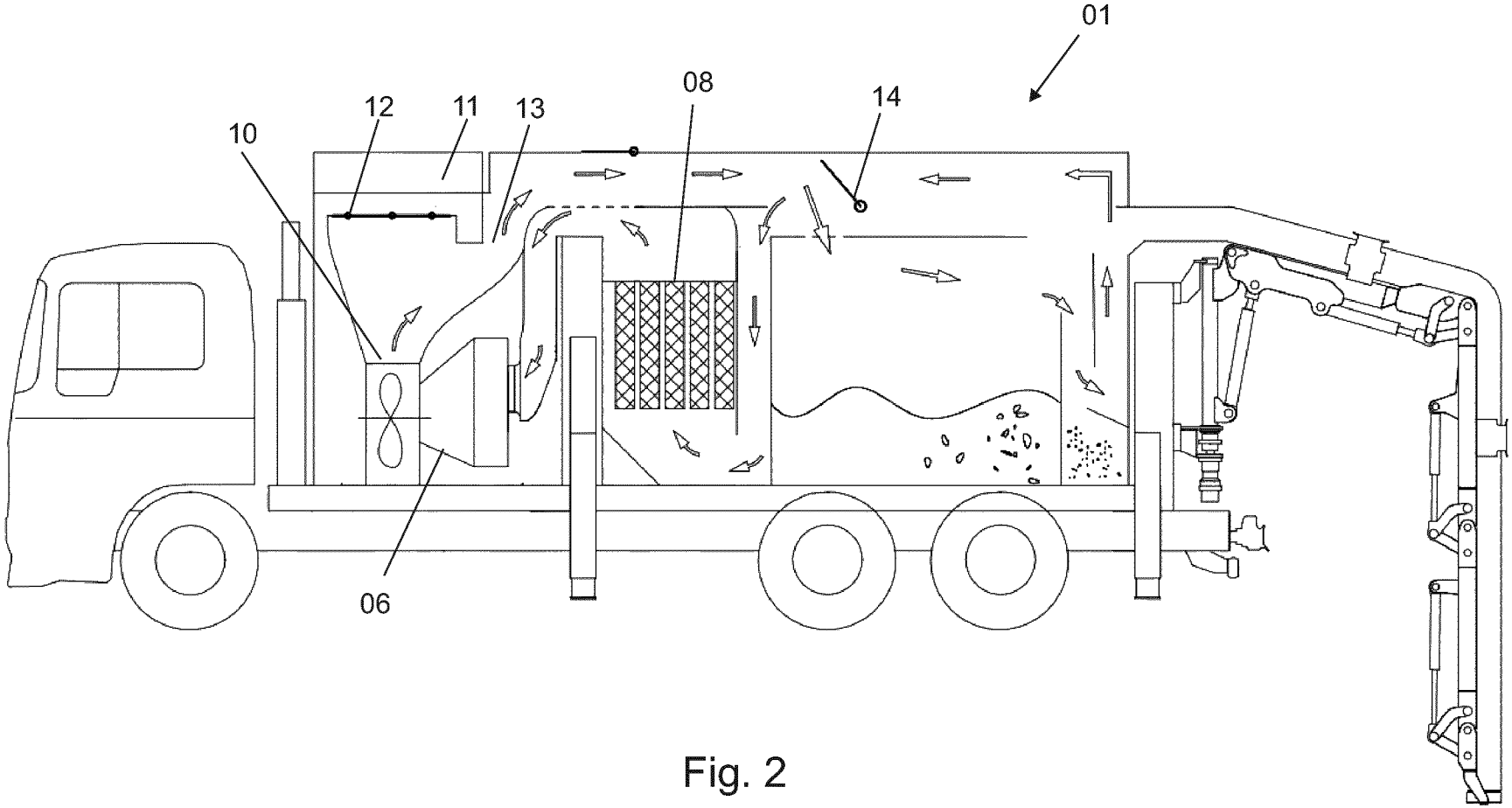
FIG. 2 shows a schematic illustration of the suction excavator, in short circuit mode.

FIG. 2 shows the suction excavator 01 in a second operating state, namely, a so-called short circuit mode in which a fluidic short circuit is created between the suction side 09 and the pressure side 10 of the fan unit 06 in order to circulate and thus heat the air within the suction excavator. The illustrated flow arrows indicate the resulting air stream over a short circuit flow path. For this purpose, an exhaust air stream switch 12 is set in such a way that the exhaust air opening 11 is completely closed, and therefore the entire exhaust air stream is fed into a recirculation channel 13. The recirculation channel 13 may include multiple flow-regulating means 14 for supplying the recirculation air to various components and heating them. In the illustrated example, the recirculation air is supplied to the separator 07. Such guiding of the recirculation air stream results in heating of at least the suction material present at the top of the separator, the separator 07, the air ducts leading from the separator to the filter unit 08, and the filter unit 08 itself. The recirculation air stream that is directed into the separator 07 is drawn in once again by the fan unit 06, compressed, and thus reheated, and once more passes via the recirculation channel 13 into the separator 07. Since the air stream is further heated upon each pass through the fan 06, this operating mode results in very rapid heat-up of the components through which the air stream flows.

In modified designs, the flow-regulating means 14 may be open at an outlet that is directed into the filter unit 08, as the result of which the entire recirculation air stream passes directly to the inlet of the filter unit 08.

Figure 3:
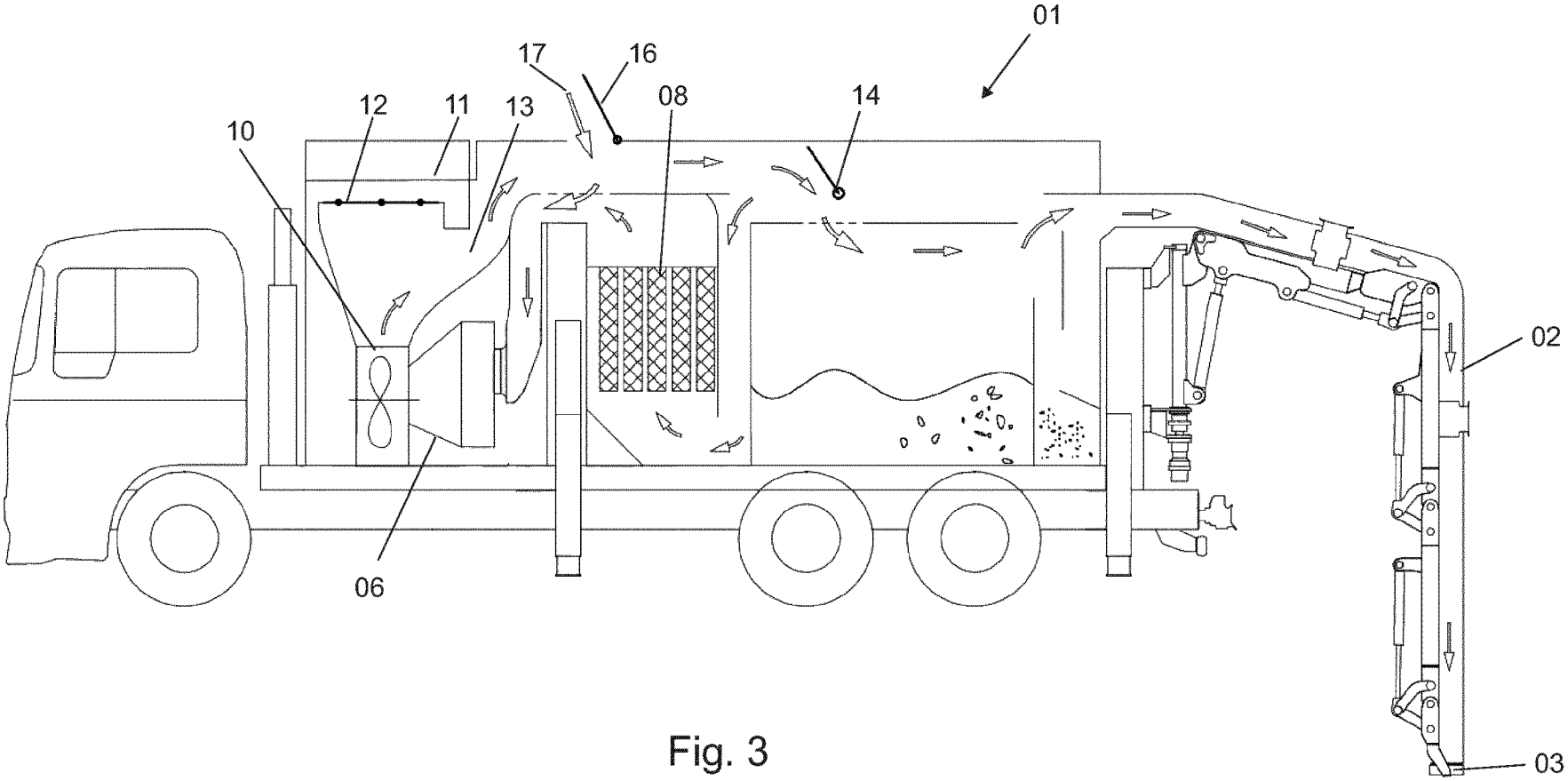
FIG. 3—shows a schematic illustration of the suction excavator, in blow-back mode.

FIG. 3 shows the suction excavator 01 in a third operating state, namely, a blow-back mode. The illustrated flow arrows indicate the resulting air stream over a blow-back path. For this purpose, the exhaust air stream switch 12 is once again closed. A secondary air opening 16 is open, so that secondary air 17 is drawn in from the surroundings when the fan unit 06 is activated. The secondary air opening 16 is situated close, in terms of flow, to the suction side 09 of the fan unit, so that the flow resistance is lower than that in the air path across the filter unit 08. This ensures that secondary air is drawn in even when the recirculation air, which continues to be led through the recirculation channel 13, is transported through the filter unit. In the illustrated embodiment, the flow-regulating means 14 are partially open in the blow-back mode. Recirculation air is therefore directed into the separator 07. At the same time, portions of the recirculation air may be compressed and heated once again in a new pass through the fan 06. Due to the secondary air 17 that is additionally drawn in, the air volume in the separator increases, so that the pressure rises at that location, and heated recirculation air is pushed into the suction hose 02 and from there is led to the suction opening 03.

In one modified embodiment, in the blow-back mode the recirculation air is led not through the separator, but, rather, from the recirculation channel directly to the suction hose.

LIST OF REFERENCE NUMERALS

01—suction excavator
02—suction hose
03—suction opening
04—suction material
05—
06—fan unit
07—separator
08—filter unit
09—suction side
10—pressure side
11—exhaust air opening
12—exhaust air stream switch
13—recirculation channel
14—flow-regulating means
15—
16—secondary air opening
17—secondary air

The invention claimed is:

1. A suction excavator comprising:

a suction hose with a suction opening for pneumatically receiving solid or liquid suction material by means of a fast-flowing air stream;

a separator for separating the suction material from the fast-flowing air stream;

a filter unit (08), situated downstream from the separator in a flow direction, for cleaning the fast-flowing air stream;

a fan unit for generating the fast-flowing air stream, a suction side of the fan unit being connected to an outlet of the filter unit, and a pressure side of the fan unit being connected to an exhaust air opening that is to open to a surrounding area;

a recirculation channel that is connectable to the pressure side of the fan unit in a volume-controllable manner;

wherein a volume-controllable secondary air opening is situated downstream from the filter unit in the flow direction that allows secondary air from the surrounding area to be supplied to the suction side of the fan unit, the recirculation channel being fluidically coupleable to the suction hose, and wherein a portion of recirculation air that is led through the recirculation channel is controllable to generate a positive pressure in the recirculation channel that results in recirculation air being blown out through the suction hose.

2. The suction excavator according to claim 1, wherein the fan unit includes at least two fans that are fluidically connected in series.

3. The suction excavator according to claim 1, wherein the secondary air opening opens into a flow section that extends between the filter unit and the suction side of the fan unit, and the secondary air opening includes an adjustable opening flap for changing an internal opening cross section between a closed position and a maximally open position.

4. The suction excavator according to claim 1, wherein the recirculation channel is additionally connected via a flow-regulating means to a parallel air duct that ends in a vicinity of the suction opening to deliver heated recirculation air at that location.

5. The suction excavator according to claim 1, further comprising blocking means which fluidically block at least the exhaust air opening, so that when the fan unit is activated, the air is circulated through the filter unit and the fan unit in order to heat the filter unit and the fan unit.

6. The suction excavator according to claim 1, further comprising at least one temperature sensor for determining the temperature of components and supplying the determined temperature to a control unit, which controls an operating mode and a volume regulation of various air streams.

7. The suction excavator according to claim 1, wherein the recirculation channel is coupleable to the separator via flow-regulating means, so that the recirculation channel is fluidically connected to the suction hose via the separator.

8. The suction excavator according to claim 5, wherein the blocking means fluidically blocks the suction hose, a parallel air duct, and the separator.

9. A method for controlling a suction excavator, comprising the following steps:

selecting an operating mode from a group of operating modes that includes at least one suction mode and one blow-back mode, wherein the following steps are carried out in the suction mode:

activating a fan unit for generating an air stream;

setting flow-regulating means so that the air stream extends over a suction flow path, beginning at a suction opening of a suction hose, into a separator, subsequently through a filter unit to the fan unit, and from there to a surrounding area via an exhaust air opening);

and wherein the following steps are carried out in the blow-back mode:

activating the fan unit for generating the air stream;

setting the flow-regulating means so that the air stream extends, at least partially, over a blow-back path, beginning at a secondary air opening, through the fan unit, into a recirculation channel to the suction hose, and up to the suction opening of the suction hose.

10. The method according to claim 9, wherein the group of operating modes also includes a short circuit mode in which the following steps are carried out:

activating the fan unit for generating the air stream;

setting the flow-regulating means so that the air stream extends, at least partially, over a closed short circuit flow path that runs at least through the filter unit to the fan unit, and from the fan unit back to the filter unit, wherein no air is supplied from outside and no air is emitted to the outside.

11. The method according to claim 10, wherein the group of operating modes also includes a suction mode having a heat-up function, in which the following steps are carried out:

activating the fan unit for generating an air stream;

setting the flow-regulating means so that the air stream extends partially over the suction flow path and partially over the short circuit flow path.

* * * * *